US007868861B2

(12) United States Patent
Cho et al.

(10) Patent No.: US 7,868,861 B2
(45) Date of Patent: Jan. 11, 2011

(54) LIQUID CRYSTAL DISPLAY DEVICE

(75) Inventors: Hyung Nyuck Cho, Seoul (KR); Nam Wook Cho, Seoul (KR); Soo Young Yoon, Seoul (KR); Min Doo Chun, Seoul (KR)

(73) Assignee: LG Display Co., Ltd., Seoul (KR)

( * ) Notice: Subject to any disclaimer, the term of this patent is extended or adjusted under 35 U.S.C. 154(b) by 760 days.

(21) Appl. No.: 11/896,101

(22) Filed: Aug. 29, 2007

(65) Prior Publication Data

US 2008/0079678 A1 Apr. 3, 2008

(30) Foreign Application Priority Data

Sep. 29, 2006 (KR) ..... 10-2006-0095724

(51) Int. Cl.
*G09G 3/36* (2006.01)

(52) U.S. Cl. ..... 345/87; 345/89; 345/204; 345/694; 345/695; 345/696; 349/54; 349/143

(58) Field of Classification Search ..... 345/87, 345/89, 204, 694–696; 349/54, 143
See application file for complete search history.

(56) References Cited

U.S. PATENT DOCUMENTS 6,075,505 A * 6/2000 Shiba et al. ..... 345/87
6,075,507 A * 6/2000 Miyahara et al. ..... 345/89
6,707,441 B1 * 3/2004 Hebiguchi et al. ..... 345/92
2003/0160805 A1 * 8/2003 Toji et al. ..... 345/694
2004/0104872 A1 * 6/2004 Kang et al. ..... 345/87
2006/0125755 A1 * 6/2006 Noguchi et al. ..... 345/96
2009/0102997 A1 * 4/2009 Wen et al. ..... 349/54
2010/0073617 A1 * 3/2010 Han ..... 349/143
2010/0156868 A1 * 6/2010 Hirayama ..... 345/208

* cited by examiner

*Primary Examiner*—Amare Mengistu
*Assistant Examiner*—Premal Patel
(74) *Attorney, Agent, or Firm*—McKenna Long & Aldridge LLP

(57) ABSTRACT

A liquid crystal display device is disclosed which includes first, second and third data lines arranged in one direction, a data driver for alternately supplying a data signal of a first polarity and a data signal of a second polarity to each of the first, second and third data lines during an interval of two horizontal periods, first and second gate lines arranged to cross the first to third data lines, a gate driver for sequentially driving the first and second gate lines, and first red, first green, first blue, second red, second green and second blue pixels located between the first gate line and the second gate line and arranged in order along the first and second gate lines. The first red pixel cell is connected to one side of the first data line and the second gate line. The first green pixel cell is connected to the other side of the first data line and the first gate line. The first blue pixel cell is connected to one side of the second data line and the first gate line. The second red pixel cell is connected to the other side of the second data line and the second gate line. The second green pixel cell is connected to one side of the third data line and the first gate line. The second blue pixel cell is connected to the other side of the third data line and the second gate line.

2 Claims, 10 Drawing Sheets

LIQUID CRYSTAL DISPLAY DEVICE

This application claims the benefit of Korean Patent Application No. 10-2006-0095724 filed on Sep. 29, 2006, which is hereby incorporated by reference as if fully set forth herein.

BACKGROUND OF THE INVENTION

1. Field of the Invention

The present invention relates to a liquid crystal display device, and more particularly, to a liquid crystal display device which can reduce a brightness difference between pixels to improve the quality of an image.

2. Discussion of the Related Art

In general, a liquid crystal display (LCD) device is adapted to display an image by adjusting light transmittance of liquid crystal cells depending on a video signal. An LCD device of an active matrix type is advantageous in displaying moving images in that a switching element is formed for every liquid crystal cell therein. A thin film transistor (TFT) is mainly used as the switching element.

In order to reduce the number of data lines in an LCD device, recently, much attention has been paid to a Data Line Sharing (DLS) technology in which adjacent pixels displaying different colors share one data line with each other.

Where the data line is driven in a two-dot driving manner, it is alternately charged with a positive data signal and a negative data signal during an interval of two horizontal period (2H). In this case, the data line may be successively charged with the same polarity over two adjacent periods or be charged from a positive polarity to a negative polarity (or from the negative polarity to the positive polarity) over the two adjacent periods. That is, the charged state of the data line may undergo a change.

For this reason, pixels displaying the same color may exhibit a brightness difference therebetween based on the charged states of the corresponding data lines even though they are supplied with data signals of the same gray scale. In particular, such a brightness difference between green pixels expressing a green color is very visible.

FIG. 1 is a graph showing visibilities based on wavelengths of light. It can be seen from this drawing that a green light exhibits higher visibility than a red light and a blue light. The higher visibility means that even a small brightness variation is easily seen by the human eye. In other words, because the green light exhibits higher visibility than the lights of the other colors, even a small brightness variation thereof is easily seen by the human eye. As a result, the brightness of one unit pixel consisting of a red pixel cell, a green pixel cell and a blue pixel cell can be considered to depend on the brightness of the green pixel cell. Consequently, in order to improve the picture quality of the LCD device, it is important to reduce a brightness difference between green pixels emitting the green light.

SUMMARY OF THE INVENTION

Accordingly, the present invention is directed to a liquid crystal display device that substantially obviates one or more problems due to limitations and disadvantages of the related art.

An advantage of the present invention is to provide a liquid crystal display device in which green pixels and red pixels are supplied with data signals in the same charged states of corresponding data lines, so that a brightness difference between the green pixels and a brightness difference between the red pixels can be reduced, thereby improving the quality of an image.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device comprises: first, second and third data lines arranged in one direction; a data driver for alternately supplying a data signal of a first polarity and a data signal of a second polarity to each of the first, second and third data lines at intervals of two periods, and supplying the data signal of the first polarity and the data signal of the second polarity to adjacent ones of the data lines; first and second gate lines arranged to cross the first to third data lines; a gate driver for sequentially driving the first and second gate lines; and first red, first green, first blue, second red, second green and second blue pixels located between the first gate line and the second gate line and arranged in order along the first and second gate lines, wherein the first red pixel cell is connected to one side of the first data line and the second gate line, wherein the first green pixel cell is connected to the other side of the first data line and the first gate line, wherein the first blue pixel cell is connected to one side of the second data line and the first gate line, wherein the second red pixel cell is connected to the other side of the second data line and the second gate line, wherein the second green pixel cell is connected to one side of the third data line and the first gate line, wherein the second blue pixel cell is connected to the other side of the third data line and the second gate line.

In another aspect of the present invention, a liquid crystal display device comprises: first, second and third data lines arranged in one direction; a data driver for alternately supplying a data signal of a first polarity and a data signal of a second polarity to each of the first, second and third data lines at intervals of two periods, and supplying the data signal of the first polarity and the data signal of the second polarity to adjacent ones of the data lines; first and second gate lines arranged to cross the first to third data lines; a gate driver for sequentially driving the first and second gate lines; and first green, first red, first blue, second green, second red and second blue pixels located between the first gate line and the second gate line and arranged in order along the first and second gate lines, wherein the first green pixel cell is connected to one side of the first data line and the second gate line, wherein the first red pixel cell is connected to the other side of the first data line and the first gate line, wherein the first blue pixel cell is connected to one side of the second data line and the first gate line, wherein the second green pixel cell is connected to the other side of the second data line and the second gate line, wherein the second red pixel cell is connected to one side of the third data line and the first gate line, wherein the second blue pixel cell is connected to the other side of the third data line and the second gate line.

In another aspect of the present invention, a liquid crystal display device comprises: first, second and third data lines arranged in one direction; a data driver for alternately supplying a data signal of a first polarity and a data signal of a second polarity to each of the first, second and third data lines at intervals of two periods, and supplying the data signal of the first polarity and the data signal of the second polarity to adjacent ones of the data lines; first and second gate lines arranged to cross the first to third data lines; a gate driver for sequentially driving the first and second gate lines; and first red, first green, first blue, second red, second green and second blue pixels located between the first gate line and the second gate line and arranged in order along the first gate line, wherein the first red pixel cell is connected to one side of the first data line and the first gate line, wherein the first green pixel cell is connected to the other side of the first data line and the second gate line, wherein the first blue pixel cell is connected to one side of the second data line and the second gate line, wherein the second red pixel cell is connected to the other side of the second data line and the first gate line, wherein the second green pixel cell is connected to one side of the third data line and the second gate line, wherein the second blue pixel cell is connected to the other side of the third data line and the first gate line.

In another aspect of the present invention, a liquid crystal display device comprises: first, second and third data lines arranged in one direction; a data driver for alternately supplying a data signal of a first polarity and a data signal of a second polarity to each of the first, second and third data lines at intervals of two periods, and supplying the data signal of the first polarity and the data signal of the second polarity to adjacent ones of the data lines; first and second gate lines arranged to cross the first to third data lines; a gate driver for sequentially driving the first and second gate lines; and first green, first red, first blue, second green, second red and second blue pixels located between the first gate line and the second gate line and arranged in order along the first gate line, wherein the first green pixel cell is connected to one side of the first data line and the first gate line, wherein the first red pixel cell is connected to the other side of the first data line and the second gate line, wherein the first blue pixel cell is connected to one side of the second data line and the second gate line, wherein the second green pixel cell is connected to the other side of the second data line and the first gate line, wherein the second red pixel cell is connected to one side of the third data line and the second gate line, wherein the second blue pixel cell is connected to the other side of the third data line and the first gate line.

In a further aspect of the present invention, a liquid crystal display device comprises: first, second and third data lines arranged in one direction; a data driver for alternately supplying a data signal of a first polarity and a data signal of a second polarity to each of the first, second and third data lines at intervals of two periods, and supplying the data signal of the first polarity and the data signal of the second polarity to adjacent ones of the data lines; first and second gate lines arranged to cross the first to third data lines; a gate driver for sequentially driving the first and second gate lines; and first blue, first green, first red, second blue, second green and second red pixels located between the first gate line and the second gate line and arranged in order along the first and second gate lines, wherein the first blue pixel cell is connected to one side of the first data line and the second gate line, wherein the first green pixel cell is connected to the other side of the first data line and the first gate line, wherein the first red pixel cell is connected to one side of the second data line and the second gate line, wherein the second blue pixel cell is connected to the other side of the second data line and the first gate line, wherein the second green pixel cell is connected to one side of the third data line and the first gate line, wherein the second red pixel cell is connected to the other side of the third data line and the second gate line.

In a further aspect of the present invention, a liquid crystal display device comprises: first, second and third data lines arranged in one direction; a data driver for alternately supplying a data signal of a first polarity and a data signal of a second polarity to each of the first, second and third data lines at intervals of two periods, and supplying the data signal of the first polarity and the data signal of the second polarity to adjacent ones of the data lines; first and second gate lines arranged to cross the first to third data lines; a gate driver for sequentially driving the first and second gate lines; and first blue, first red, first green, second blue, second red and second green pixels located between the first gate line and the second gate line and arranged in order along the first and second gate lines, wherein the first blue pixel cell is connected to one side of the first data line and the second gate line, wherein the first red pixel cell is connected to the other side of the first data line and the first gate line, wherein the first green pixel cell is connected to one side of the second data line and the second gate line, wherein the second blue pixel cell is connected to the other side of the second data line and the first gate line, wherein the second red pixel cell is connected to one side of the third data line and the first gate line, wherein the second green pixel cell is connected to the other side of the third data line and the second gate line.

In another aspect of the present invention, a liquid crystal display device comprises: first, second and third data lines arranged in one direction; a data driver for alternately supplying a data signal of a first polarity and a data signal of a second polarity to each of the first, second and third data lines at intervals of two periods, and supplying the data signal of the first polarity and the data signal of the second polarity to adjacent ones of the data lines; first and second gate lines arranged to cross the first to third data lines; a gate driver for sequentially driving the first and second gate lines; and first blue, first green, first red, second blue, second green and second red pixels located between the first gate line and the second gate line and arranged in order along the first and second gate lines, wherein the first blue pixel cell is connected to one side of the first data line and the first gate line, wherein the first green pixel cell is connected to the other side of the first data line and the second gate line, wherein the first red pixel cell is connected to one side of the second data line and the first gate line, wherein the second blue pixel cell is connected to the other side of the second data line and the second gate line, wherein the second green pixel cell is connected to one side of the third data line and the second gate line, wherein the second red pixel cell is connected to the other side of the third data line and the first gate line.

In yet another aspect of the present invention, a liquid crystal display device comprises: first, second and third data lines arranged in one direction; a data driver for alternately supplying a data signal of a first polarity and a data signal of a second polarity to each of the first, second and third data lines at intervals of two periods, and supplying the data signal of the first polarity and the data signal of the second polarity to adjacent ones of the data lines; first and second gate lines arranged to cross the first to third data lines; a gate driver for sequentially driving the first and second gate lines; and first blue, first red, first green, second blue, second red and second green pixels located between the first gate line and the second gate line and arranged in order along the first and second gate lines, wherein the first blue pixel cell is connected to one side of the first data line and the first gate line, wherein the first green pixel cell is connected to the other side of the first data line and the second gate line, wherein the first red pixel cell is connected to one side of the second data line and the first gate line, wherein the second blue pixel cell is connected to the other side of the second data line and the second gate line, wherein the second green pixel cell is connected to one side of the third data line and the second gate line, wherein the second red pixel cell is connected to the other side of the third data line and the first gate line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to embodiments of the present invention, examples of which are illustrated in the accompanying drawings. Wherever possible, the same reference numbers will be used throughout the drawings to refer to the same or like parts.

Figure 1:
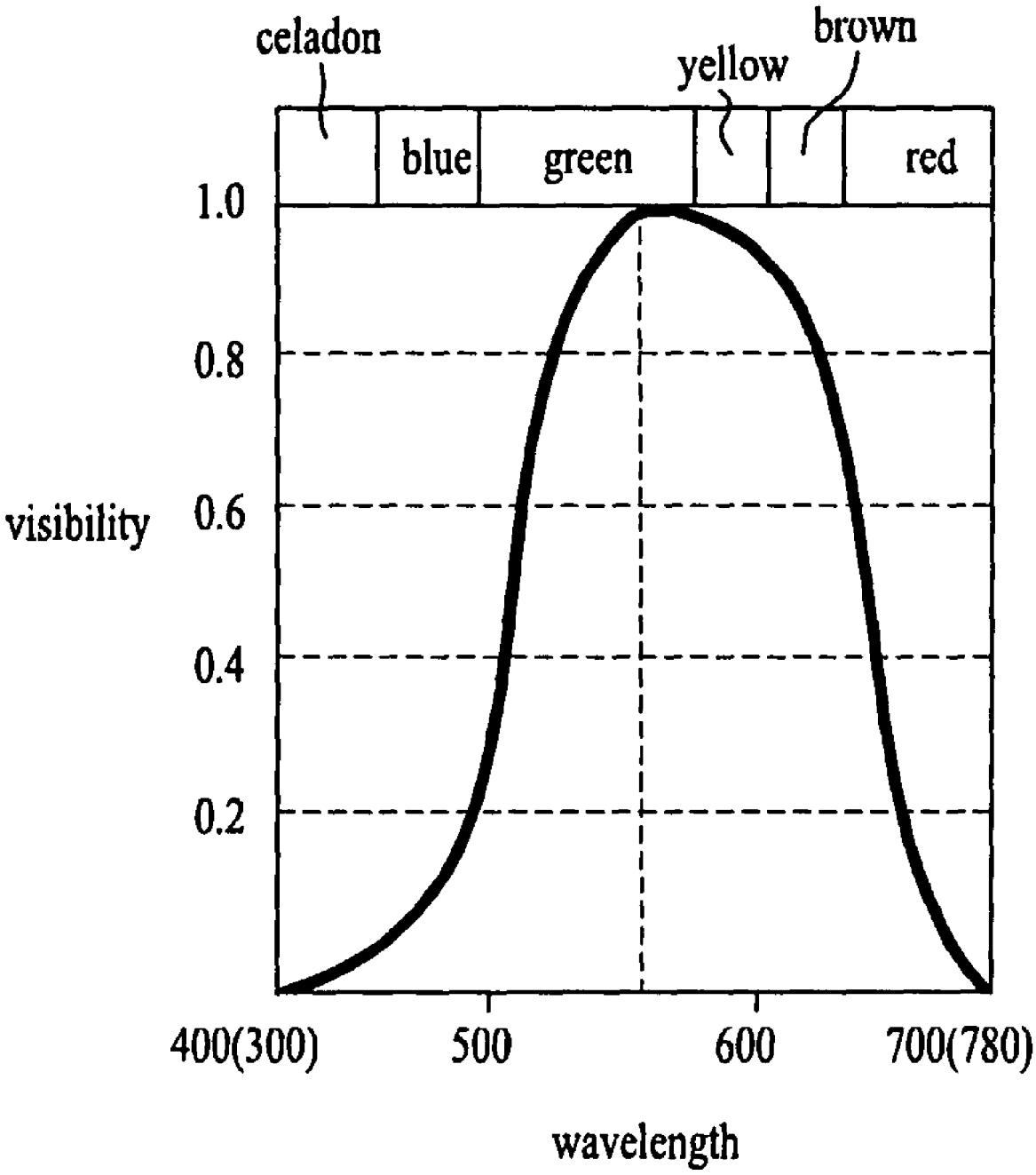
FIG. 1 Related Art
FIG. 1 is a graph showing visibilities based on wavelengths of light.
Figure 2:
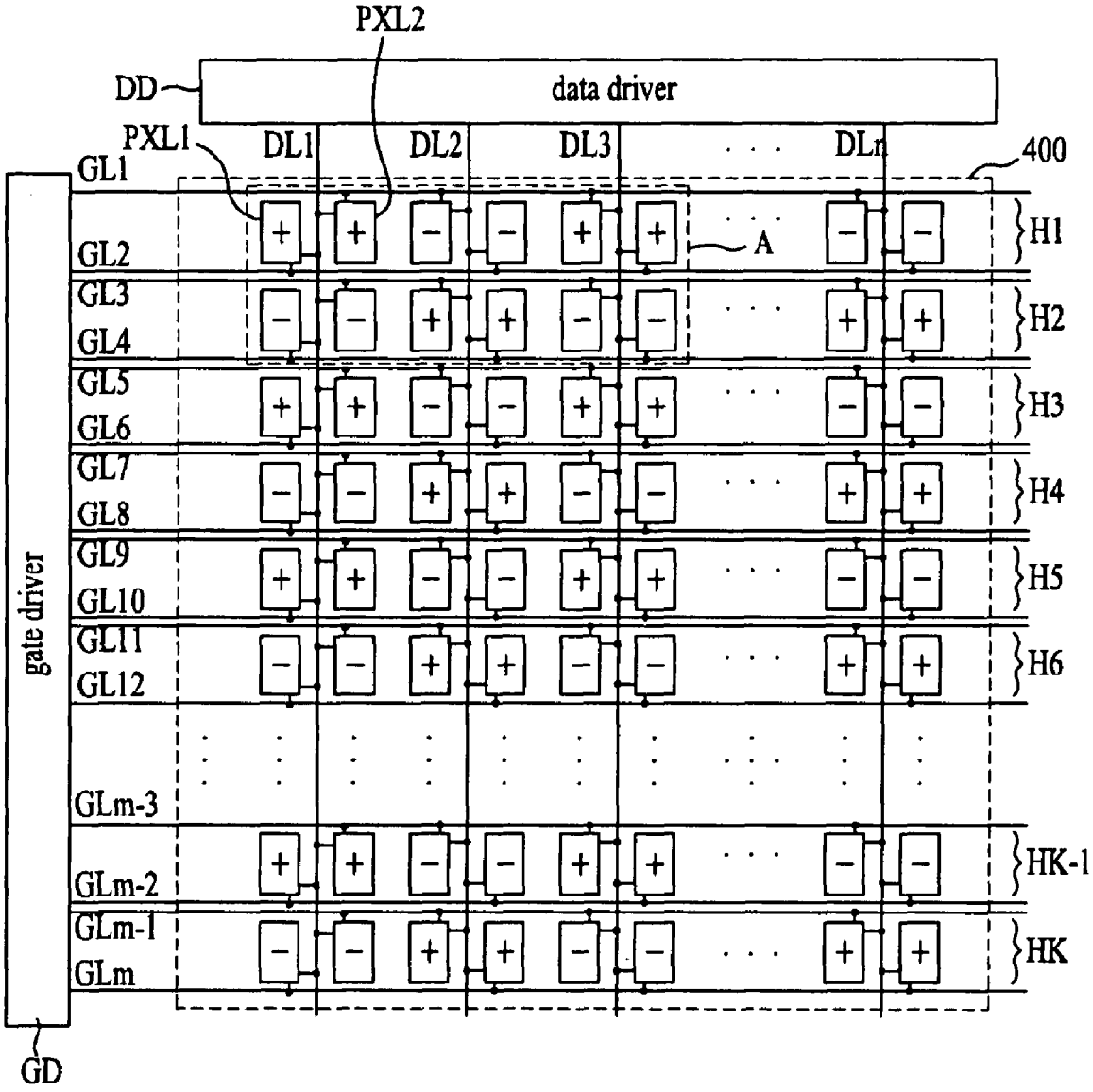
FIG. 2 is a schematic view of a liquid crystal display device according to a first embodiment of the present invention.

FIG. 2 is a schematic view of a liquid crystal display (LCD) device according to a first embodiment of the present invention.

The LCD device according to the first embodiment of the present invention includes, as shown in FIG. 2, a liquid crystal panel 400 having a plurality of pixel rows HL1, HL2, HL3, HL4, . . . , HLK, a plurality of data lines DL1 to DLn arranged to cross the pixel rows HL1 to HLK, a plurality of first pixels PXL1 formed respectively in the pixel rows HL1 to HLK to be located respectively at the left sides of the data lines DL1 to DLn, and connected respectively to the left sides of the data lines DL1 to DLn, a plurality of second pixels PXL2 formed respectively in the pixel rows HL1 to HLK to be located respectively at the right sides of the data lines DL1 to DLn, and connected respectively to the right sides of the data lines DL1 to DLn, a plurality of gate lines A GL1, GL3, . . . , GLm-1 formed respectively at the tops of the pixel rows HL1 to HLK, a plurality of gate lines B GL2, GL4, . . . , GLm formed respectively at the bottoms of the pixel rows HL1 to HLK, a gate driver GD for driving the gate lines A and B GL1 to GLm, and a data driver DD for driving the data lines DL1 to DLn.

Each of the pixels PXL1 and PXL2 includes a thin film transistor (TFT) turned on in response to a gate signal from a corresponding gate line for switching a data signal from a corresponding data line, and a pixel electrode for receiving the data signal from the TFT and displaying an image corresponding to the received data signal.

The pixels in each pixel row are repeatedly arranged in the order of a red pixel cell, a green pixel cell and a blue pixel cell.

The gate lines A GL1, GL3, . . . , GLm-1 mean odd gate lines, and the gate lines B GL2, GL4, . . . , GLm mean even gate lines. These gate lines GL1 to GLm are driven in order from the top gate line to the bottom gate line. To this end, the gate driver GD sequentially outputs gate signals and sequentially supplies the outputted gate signals to the first to mth gate lines GL1 to GLm. As a result, in a period of one frame, the first gate line GL1 is driven first of all and the mth gate line GLm is driven last of all.

A data signal is supplied to each of the data lines DL1 to DLn whenever each of the gate lines GL1 to GLm is driven. At this time, a positive data signal and a negative data signal are alternately supplied to each of the data lines DL1 to DLn during an interval of two horizontal periods. That is, a positive data signal is supplied to one data line for two horizontal periods, and a negative data signal is then supplied to that data line for the following two horizontal periods. Also, data signals of different polarities are supplied to adjacent data lines in the same period.

A block A represents one unit pixel array. The liquid crystal panel 400 of the first embodiment of the present invention has a plurality of unit pixel arrays formed in matrix form.

Figure 3:
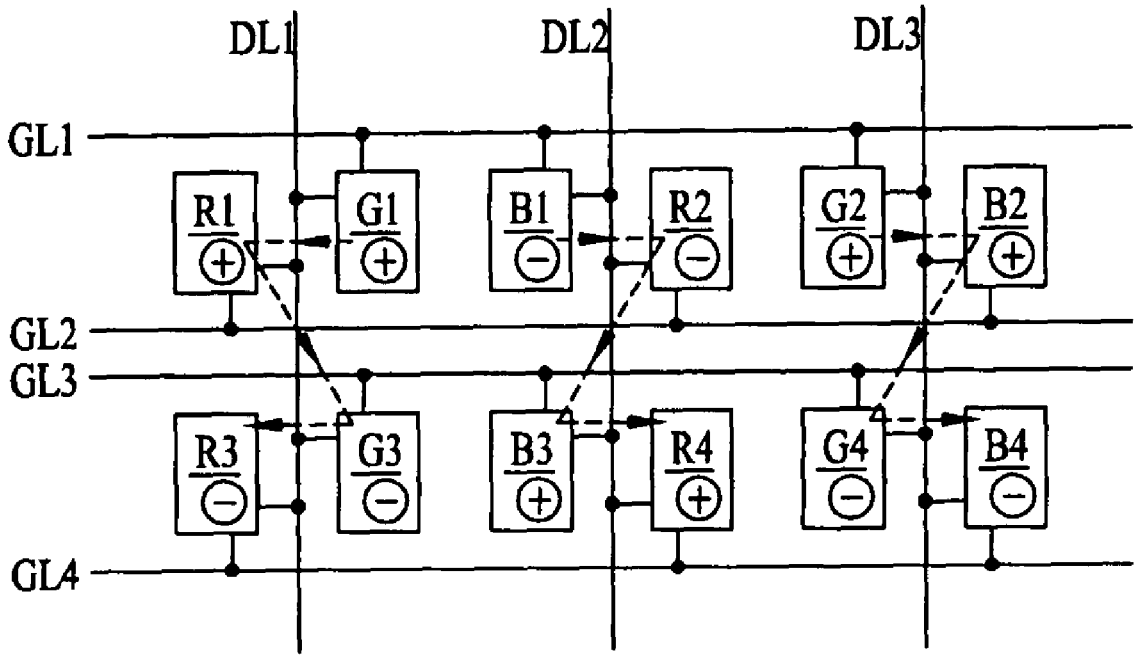
FIG. 3 is an enlarged view of a block A in FIG. 2.
Figure 4:
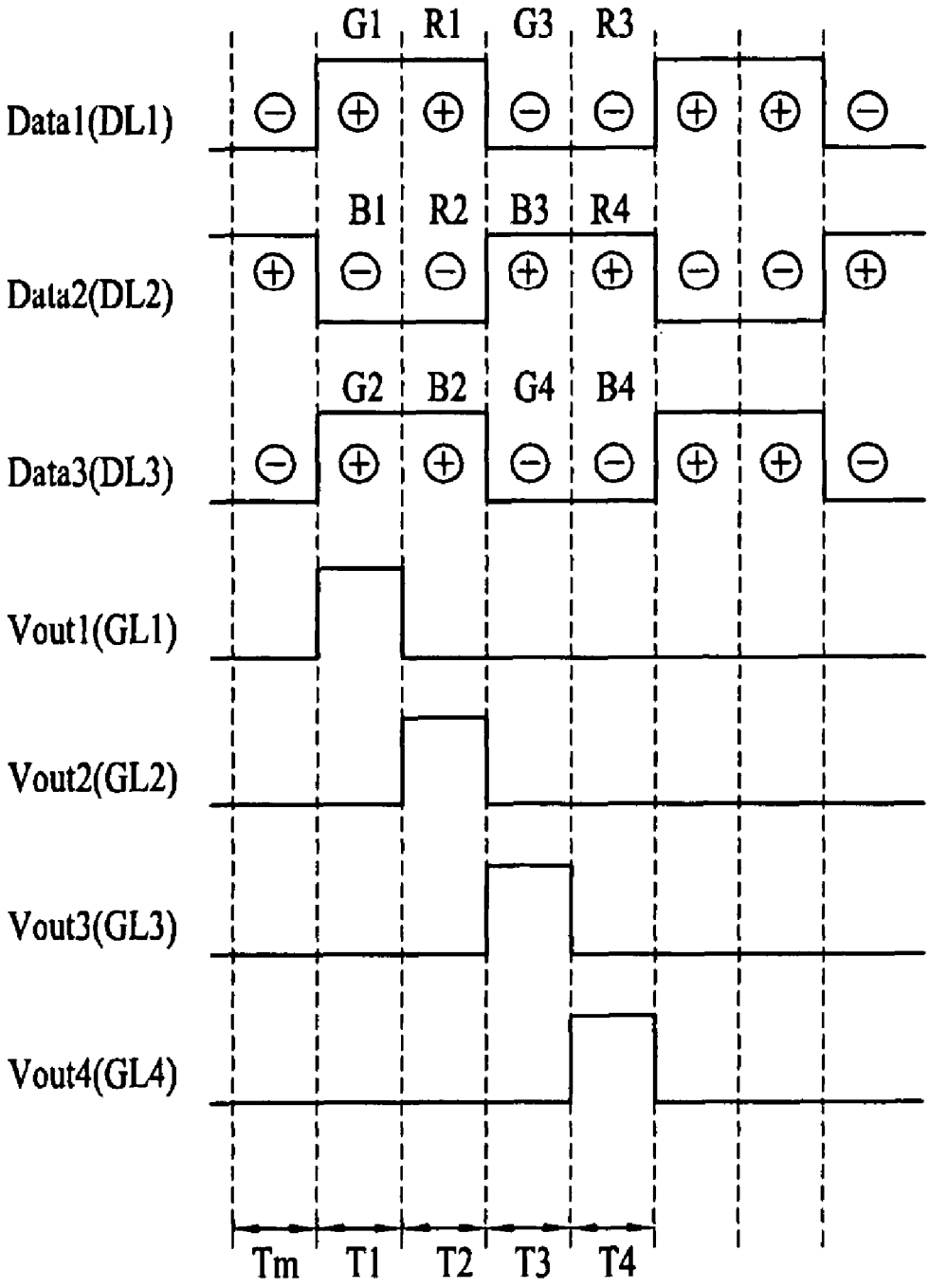
FIG. 4 is a timing diagram of gate signals and data signals supplied to pixels in FIG. 3.

FIG. 3 is an enlarged view of the block A in FIG. 2, and FIG. 4 is a timing diagram of gate signals and data signals supplied to pixels in FIG. 3.

As shown in FIG. 3, the unit pixel array includes first, second and third data lines DL1, DL2 and DL3 arranged in one direction, first, second, third and fourth gate lines GL1, GL2, GL3 and GL4 arranged to cross the first to third data lines DL1 to DL3, first red, first green, first blue, second red, second green and second blue pixels R1, G1, B1, R2, G2 and B2 located between the first gate line GL1 and the second gate line GL2 and arranged in order along the first gate line GL1, and third red, third green, third blue, fourth red, fourth green and fourth blue pixels R3, G3, B3, R4, G4 and B4 located between the third gate line GL3 and the fourth gate line GL4 and arranged in order along the third gate line GL3.

The first red pixel cell R1 is connected to one side of the first data line DL1 and the second gate line GL2.

The first green pixel cell G1 is connected to the other side of the first data line DL1 and the first gate line GL1.

The first blue pixel cell B1 is connected to one side of the second data line DL2 and the first gate line GL1.

The second red pixel cell R2 is connected to the other side of the second data line DL2 and the second gate line GL2.

The second green pixel cell G2 is connected to one side of the third data line DL3 and the first gate line GL1.

The second blue pixel cell B2 is connected to the other side of the third data line DL3 and the second gate line GL2.

The third red pixel cell R3 is connected to one side of the first data line DL1 and the fourth gate line GL4.

The third green pixel cell G3 is connected to the other side of the first data line DL1 and the third gate line GL3.

The third blue pixel cell B3 is connected to one side of the second data line DL2 and the third gate line GL3.

The fourth red pixel cell R4 is connected to the other side of the second data line DL2 and the fourth gate line GL4.

The fourth green pixel cell G4 is connected to one side of the third data line DL3 and the third gate line GL3.

The fourth blue pixel cell B4 is connected to the other side of the third data line DL3 and the fourth gate line GL4.

Here, the pixels connected to the first data line DL1 are driven in the order of the first green pixel cell G1, first red pixel cell R1, third green pixel cell G3 and third red pixel cell R3.

The pixels connected to the second data line DL2 are driven in the order of the first blue pixel cell B1, second red pixel cell R2, third blue pixel cell B3 and fourth red pixel cell R4.

The pixels connected to the third data line DL3 are driven in the order of the second green pixel cell G2, second blue pixel cell B2, fourth green pixel cell G4 and fourth blue pixel cell B4.

Positive, positive, negative and negative data signals Data1 are sequentially supplied to the first data line DL1 for first to fourth periods T1 to T4.

Negative, negative, positive and positive data signals Data2 are sequentially supplied to the second data line DL2 for the first to fourth periods T1 to T4.

Positive, positive, negative and negative data signals Data3 are sequentially supplied to the third data line DL3 for the first to fourth periods T1 to T4.

A description will hereinafter be given of an operation for the first period T1 in an arbitrary frame period.

In the first period T1, a first gate signal GS1 is outputted and supplied to the first gate line GL1. As a result, the first green pixel cell G1, first blue pixel cell B1 and second green pixel cell G2 connected to the first gate line GL1 are driven at the same time.

In this first period T1, a positive data signal Data1 is charged on the first data line DL1, a negative data signal Data2 is charged on the second data line DL2, and a positive data signal Data3 is charged on the third data line DL3.

Accordingly, in this first period T1, the first green pixel cell G1 is supplied with the positive data signal Data1 charged on the first data line DL1 to display an image, the first blue pixel cell B1 is supplied with the negative data signal Data2 charged on the second data line DL2 to display an image, and the second green pixel cell G2 is supplied with the positive data signal Data3 charged on the third data line DL3 to display an image.

Here, in an mth period Tm immediately preceding the first period T1, namely, a last one of periods included in a frame period immediately preceding the arbitrary frame period, the first data line DL1 was charged with a negative data signal Data1, the second data line DL2 was charged with a positive data signal Data2, and the third data line DL3 was charged with a negative data signal Data3.

As a result, in the first period T1, the first data line DL1 is charged from the negative data signal Data1 to the positive data signal Data1, the second data line DL2 is charged from the positive data signal Data2 to the negative data signal Data2, and the third data line DL3 is charged from the negative data signal Data3 to the positive data signal Data3.

This first period T1 is a time for which a data signal Data1 corresponding to the first green pixel cell G1, a data signal Data2 corresponding to the first blue pixel cell B1, and a data signal Data3 corresponding to the second green pixel cell G2 are supplied to the first, second and third data lines DL1, DL2 and DL3, respectively. The first green pixel cell G1 and the second green pixel cell G2 are supplied with the data signals Data1 and Data3 in the same charged states.

That is, the data signal Data1 supplied to the first data line DL1 in the first period T1 in which the first green pixel cell G1 is supplied with the data signal Data1 has an opposite polarity to that of the data signal Data1 supplied to the first data line DL1 in a period immediately preceding this first period T1, namely, the mth period Tm. Also, the data signal Data3 supplied to the third data line DL3 in the first period T1 in which the second green pixel cell G2 is supplied with the data signal Data3 has an opposite polarity to that of the data signal Data3 supplied to the third data line DL3 in the mth period Tm.

Therefore, provided that the data signals Data1 and Data3 of the same gray scale are supplied to the first and third data lines DL1 and DL3 in the first period T1, the first green pixel cell G1 and the second green pixel cell G2 will display images of the same brightness.

Next, a description will be given of an operation for the second period T2 in the arbitrary frame period.

In the second period T2, a second gate signal GS2 is outputted and supplied to the second gate line GL2. As a result, the first red pixel cell R1, second red pixel cell R2 and second blue pixel cell B2 connected to the second gate line GL2 are driven at the same time.

In this second period T2, a positive data signal Data1 is charged on the first data line DL1, a negative data signal Data2 is charged on the second data line DL2, and a positive data signal Data3 is charged on the third data line DL3. That is, the data signals Data1, Data2 and Data3 supplied respectively to the data lines DL1 to DL3 in the first period T1 are the same in polarity as the data signals Data1, Data2 and Data3 supplied respectively to the data lines DL1 to DL3 in the second period T2, respectively.

Thus, in this second period T2, the first red pixel cell R1 is supplied with the positive data signal Data1 charged on the first data line DL1 to display an image, the second red pixel cell R2 is supplied with the negative data signal Data2 charged on the second data line DL2 to display an image, and the second blue pixel cell B2 is supplied with the positive data signal Data3 charged on the third data line DL3 to display an image.

Here, in a period immediately preceding the second period T2, namely, the first period T1, the first data line DL1 was charged with a positive data signal Data1, the second data line DL2 was charged with a negative data signal Data2, and the third data line DL3 was charged with a positive data signal Data3.

As a result, in the second period T2, the first data line DL1 is charged from the positive data signal Data1 to the positive data signal Data1, the second data line DL2 is charged from the negative data signal Data2 to the negative data signal Data2, and the third data line DL3 is charged from the positive data signal Data3 to the positive data signal Data3.

This second period T2 is a time for which a data signal Data1 corresponding to the first red pixel cell R1, a data signal Data2 corresponding to the second red pixel cell R2, and a data signal Data3 corresponding to the second blue pixel cell B2 are supplied to the first, second and third data lines DL1, DL2 and DL3, respectively. The first red pixel cell R1 and the second red pixel cell R2 are supplied with the data signals Data1 and Data2 in the same charged states.

That is, the data signal Data1 supplied to the first data line DL1 in the second period T2 in which the first red pixel cell R1 is supplied with the data signal Data1 has the same polarity as that of the data signal Data1 supplied to the first data line DL1 in a period immediately preceding this second period T2, namely, the first period T1. Also, the data signal Data2 supplied to the second data line DL2 in the second period T2 in which the second red pixel cell R2 is supplied with the data signal Data2 has the same polarity as that of the data signal Data2 supplied to the second data line DL2 in the first period T1.

Therefore, provided that the data signals Data1 and Data2 of the same gray scale are supplied to the first and second data lines DL1 and DL2 in the second period T2, the first red pixel cell R1 and the second red pixel cell R2 will display images of the same brightness.

Next, a description will be given of an operation for the third period T3 in the arbitrary frame period.

In the third period T3, a third gate signal GS3 is outputted and supplied to the third gate line GL3. As a result, the third green pixel cell G3, third blue pixel cell B3 and fourth green pixel cell G4 connected to the third gate line GL3 are driven at the same time.

In this third period T3, a negative data signal Data1 is charged on the first data line DL1, a positive data signal Data2 is charged on the second data line DL2, and a negative data signal Data3 is charged on the third data line DL3. That is, the data signals Data1, Data2 and Data3 supplied respectively to the data lines DL1 to DL3 in the third period T3 are opposite in polarity to the data signals Data1, Data2 and Data3 supplied respectively to the data lines DL1 to DL3 in the second period T2, respectively.

Accordingly, in this third period T3, the third green pixel cell G3 is supplied with the negative data signal Data charged on the first data line DL1 to display an image, the third blue pixel cell B3 is supplied with the positive data signal Data2 charged on the second data line DL2 to display an image, and the fourth green pixel cell G4 is supplied with the negative data signal Data3 charged on the third data line DL3 to display an image.

Here, in a period immediately preceding the third period T3, namely, the second period T2, the first data line DL1 was charged with a positive data signal Data1, the second data line DL2 was charged with a negative data signal Data2, and the third data line DL3 was charged with a positive data signal Data3.

As a result, in the third period T3, the first data line DL1 is charged from the positive data signal Data1 to the negative data signal Data1, the second data line DL2 is charged from the negative data signal Data2 to the positive data signal Data2, and the third data line DL3 is charged from the positive data signal Data3 to the negative data signal Data3.

This third period T3 is a time for which a data signal Data1 corresponding to the third green pixel cell G3, a data signal Data2 corresponding to the third blue pixel cell B3, and a data signal Data3 corresponding to the fourth green pixel cell G4 are supplied to the first, second and third data lines DL1, DL2 and DL3, respectively. The third green pixel cell G3 and the fourth green pixel cell G4 are supplied with the data signals Data1 and Data3 in the same charged states.

That is, the data signal Data1 supplied to the first data line DL1 in the third period T3 in which the third green pixel cell G3 is supplied with the data signal Data1 has an opposite polarity to that of the data signal Data1 supplied to the first data line DL1 in a period immediately preceding this third period T3, namely, the second period T2. Also, the data signal Data3 supplied to the third data line DL3 in the third period T3 in which the fourth green pixel cell G4 is supplied with the data signal Data3 has an opposite polarity to that of the data signal Data3 supplied to the third data line DL3 in the second period T2.

Accordingly, provided that the data signals Data1 and Data3 of the same gray scale are supplied to the first and third data lines DL1 and DL3 in the third period T3, the third green pixel cell G3 and the fourth green pixel cell G4 will display images of the same brightness.

Next, a description will be given of an operation for the fourth period T4 in the arbitrary frame period.

In the fourth period T4, a fourth gate signal GS4 is outputted and supplied to the fourth gate line GL4. As a result, the third red pixel cell R3, fourth red pixel cell R4 and fourth blue pixel cell B4 connected to the fourth gate line GL4 are driven at the same time.

In this fourth period T4, a negative data signal Data1 is charged on the first data line DL1, a positive data signal Data2 is charged on the second data line DL2, and a negative data signal Data3 is charged on the third data line DL3. That is, the data signals Data1, Data2 and Data3 supplied respectively to the data lines DL1 to DL3 in the fourth period T4 are the same in polarity as the data signals Data1, Data2 and Data3 supplied respectively to the data lines DL1 to DL3 in the third period T3, respectively.

Thus, in this fourth period T4, the third red pixel cell R3 is supplied with the negative data signal Data1 charged on the first data line DL1 to display an image, the fourth red pixel cell R4 is supplied with the positive data signal Data2 charged on the second data line DL2 to display an image, and the fourth blue pixel cell B4 is supplied with the negative data signal Data3 charged on the third data line DL3 to display an image.

Here, in a period immediately preceding the fourth period T4, namely, the third period T3, the first data line DL1 was charged with a negative data signal Data1, the second data line DL2 was charged with a positive data signal Data2, and the third data line DL3 was charged with a negative data signal Data3.

As a result, in the fourth period T4, the first data line DL1 is charged from the negative data signal Data1 to the negative data signal Data1, the second data line DL2 is charged from the positive data signal Data2 to the positive data signal Data2, and the third data line DL3 is charged from the negative data signal Data3 to the negative data signal Data3.

This fourth period T4 is a time for which a data signal Data1 corresponding to the third red pixel cell R3, a data signal Data2 corresponding to the fourth red pixel cell R4, and a data signal Data3 corresponding to the fourth blue pixel cell B4 are supplied to the first, second and third data lines DL1, DL2 and DL3, respectively. The third red pixel cell R3 and the fourth red pixel cell R4 are supplied with the data signals Data1 and Data2 in the same charged states.

That is, the data signal Data1 supplied to the first data line DL1 in the fourth period T4 in which the third red pixel cell R3 is supplied with the data signal Data1 has the same polarity as that of the data signal Data1 supplied to the first data line DL1 in a period immediately preceding this fourth period T4, namely, the third period T3. Also, the data signal Data2 supplied to the second data line DL2 in the fourth period T4 in which the fourth red pixel cell R4 is supplied with the data signal Data2 has the same polarity as that of the data signal Data2 supplied to the second data line DL2 in the third period T3.

Therefore, provided that the data signals Data1 and Data2 of the same gray scale are supplied to the first and second data lines DL1 and DL2 in the fourth period T4, the third red pixel cell R3 and the fourth red pixel cell R4 will display images of the same brightness.

In this manner, the green pixels G1, G2 and G3 and the red pixels R1, R2 and R3 are supplied with data signals in the same charged states of the corresponding data lines DL1 to DL3.

Also, each of all green pixels G1, G2 and G3 is always supplied with a data signal having a polarity opposite to that of a data signal applied to the corresponding data line in the immediately preceding period, to display an image.

In addition, each of all red pixels R1, R2 and R3 is always supplied with a data signal having the same polarity as that of a data signal applied to the corresponding data line in the immediately preceding period, to display an image.

On the other hand, the blue pixels B1, B2 and B3 are supplied with data signals in different charged states of the corresponding data lines DL2 to DL3.

For example, in the third period T3, the third blue pixel cell B3 is supplied with a data signal Data2 having a polarity opposite to that of a data signal Data2 applied to the second data line DL2 in the immediately preceding period, to display an image. Also, in the fourth period T4, the fourth blue pixel cell B4 is supplied with a data signal Data3 having the same polarity as that of a data signal Data3 applied to the third data line DL3 in the immediately preceding period, to display an image. As a result, even though the data signals Data2 and Data3 of the same gray scale are supplied in the third and fourth periods T3 and T4, there may be a brightness difference between the blue pixels. However, as stated previously, each of the blue pixels B1, B2 and B3 emits a blue light of low visibility, so that a brightness difference among the blue pixels B1, B2 and B3 is little seen by the human eye.

Meanwhile, the unit pixel array of the block A may be divided into a first unit pixel array including the first red pixel cell R1, first green pixel cell G1, first blue pixel cell B1, second red pixel cell R2, second green pixel cell G2 and second blue pixel cell B2, and a second unit pixel array including the third red pixel cell R3, third green pixel cell G3, third blue pixel cell B3, fourth red pixel cell R4, fourth green pixel cell G4 and fourth blue pixel cell B4. These first and second unit pixel arrays have the same structure. Therefore, the liquid crystal panel 400 of the first embodiment of the present invention may be considered to have a plurality of first unit pixel arrays formed in a matrix form.

On the other hand, in the first embodiment of the present invention, the position of the first red pixel cell R1 and the position of the first green pixel cell G1 may be changed to each other. That is, the first red pixel cell R1 may be located at the seat of the first green pixel cell G1, and the first green pixel cell G1 may be located at the seat of the first red pixel cell R1. In other words, the seat of the first red pixel cell R1 and the seat of the first green pixel cell G1 may be changed to each other.

Of course, for the aforementioned change in the pixel cell positions, it is necessary to change the seat of the second red pixel cell R2 and the seat of the second green pixel cell G2 to each other, the seat of the third red pixel cell R3 and the seat of the third green pixel cell G3 to each other, and the seat of the fourth red pixel cell R4 and the seat of the fourth green pixel cell G4 to each other.

Next, an LCD device according to a second embodiment of the present invention will be described in detail.

Figure 5:
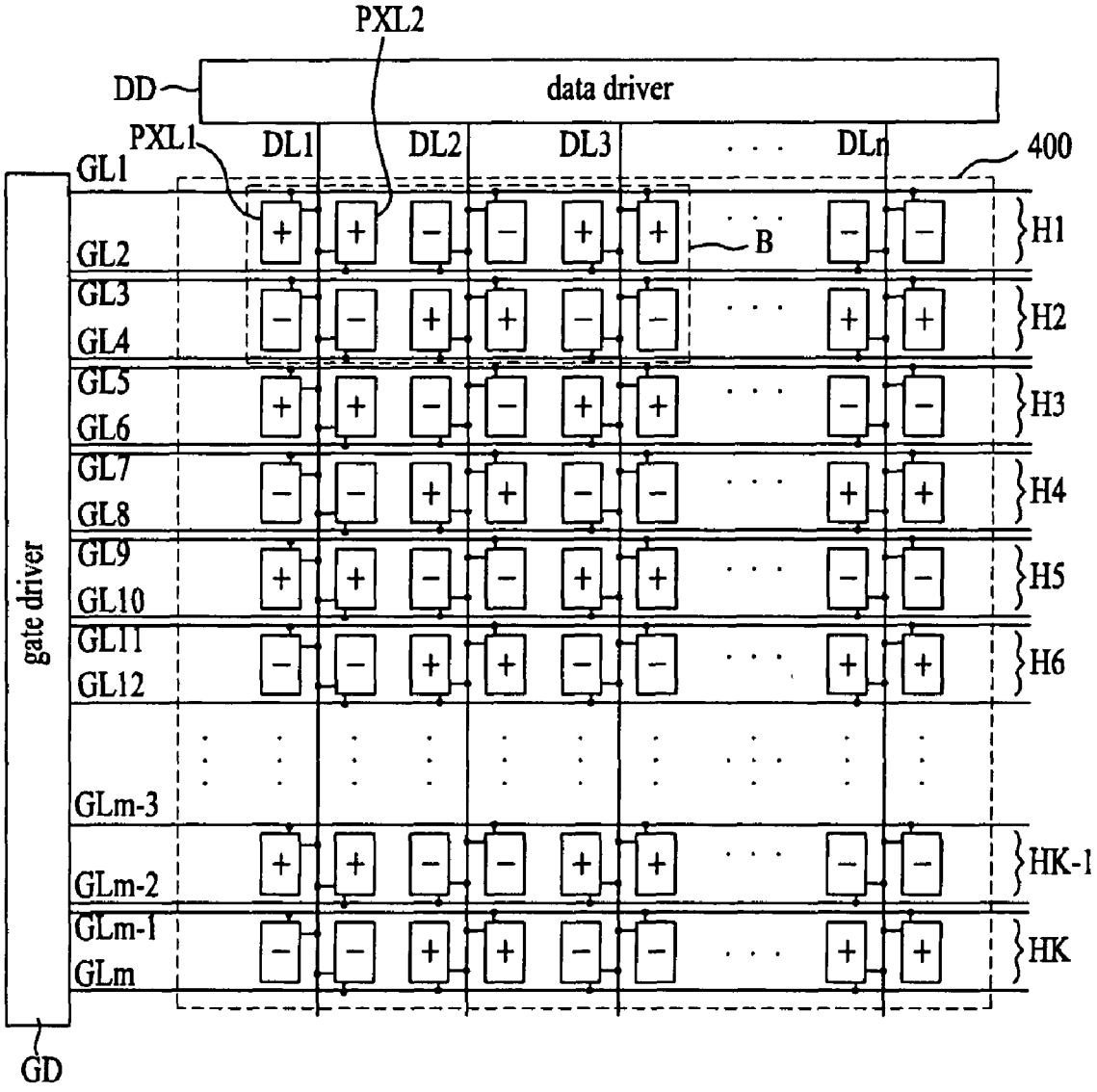
FIG. 5 is a schematic view of a liquid crystal display device according to a second embodiment of the present invention.

FIG. 5 is a schematic view of the LCD device according to the second embodiment of the present invention.

The LCD device according to the second embodiment of the present invention is substantially the same in configuration as the LCD device according to the first embodiment as stated above, with the exception that connections between pixels and gate lines are made in a different manner.

A block B represents one unit pixel array. A liquid crystal panel 400 of the second embodiment of the present invention has a plurality of unit pixel arrays formed in matrix form.

Figure 6:
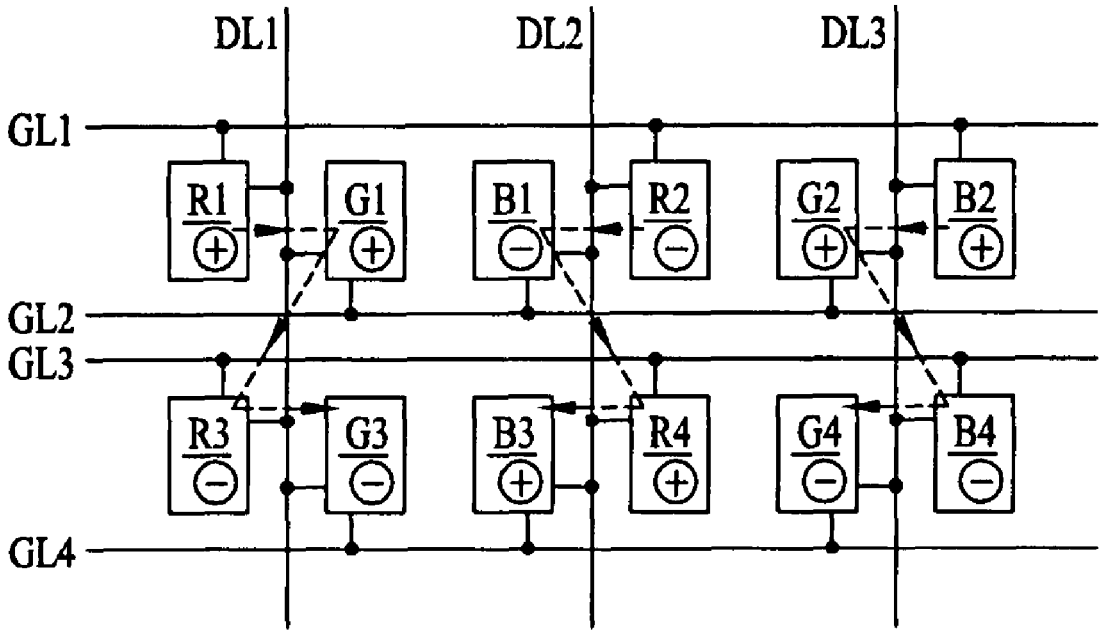
FIG. 6 is an enlarged view of a block B in FIG. 5.
Figure 7:
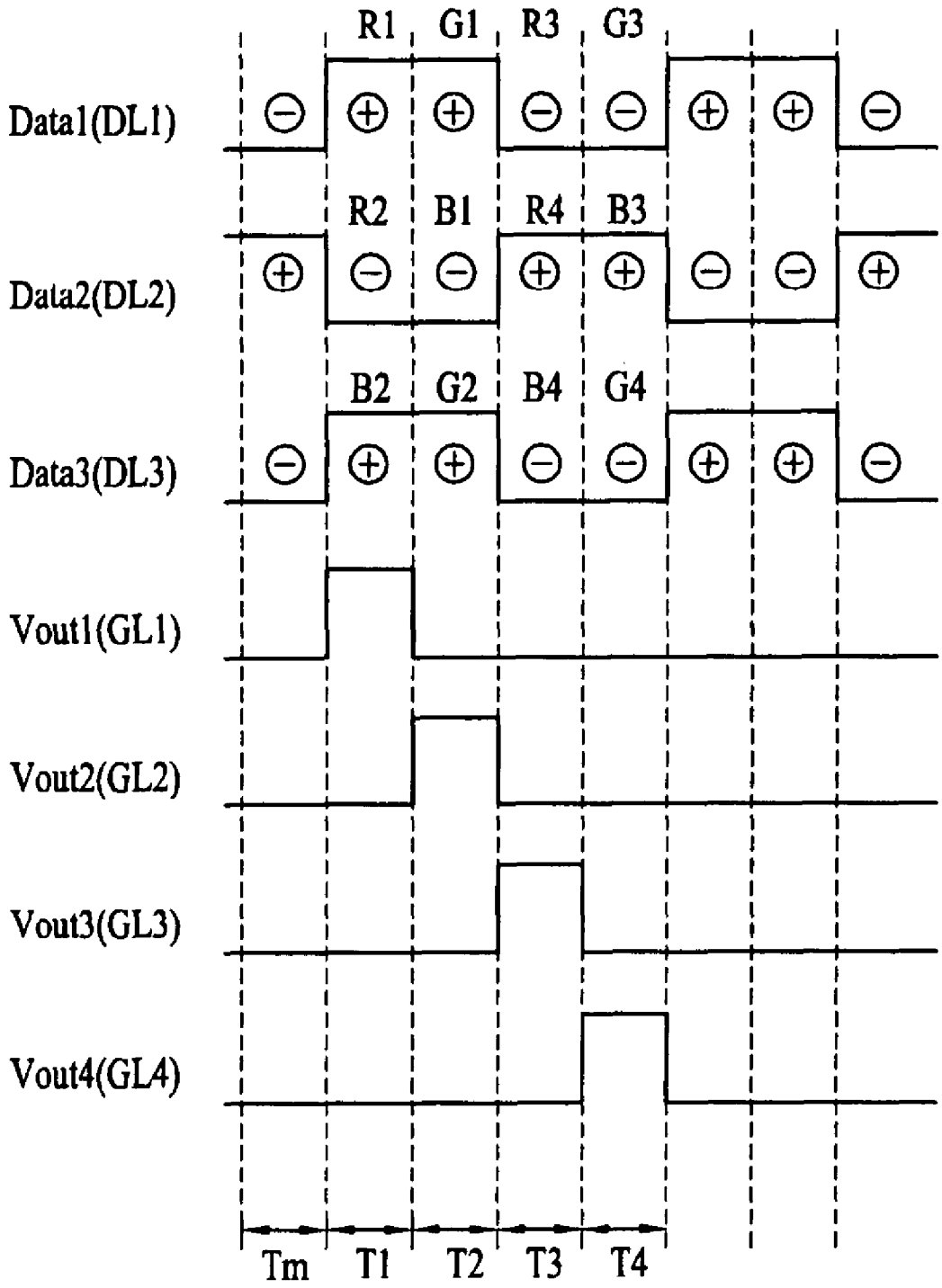
FIG. 7 is a timing diagram of gate signals and data signals supplied to pixels in FIG. 6.

FIG. 6 is an enlarged view of the block B in FIG. 5, and FIG. 7 is a timing diagram of gate signals and data signals supplied to pixels in FIG. 6.

As shown in FIG. 6, the unit pixel array includes first, second and third data lines DL1, DL2 and DL3 arranged in one direction, first, second, third and fourth gate lines GL1, GL2, GL3 and GL4 arranged to cross the first to third data lines DL1 to DL3, first red, first green, first blue, second red, second green and second blue pixels R1, G1, B1, R2, G2 and B2 located between the first gate line GL1 and the second gate line GL2 and arranged in order along the first gate line GL1, and third red, third green, third blue, fourth red, fourth green and fourth blue pixels R3, G3, B3, R4, G4 and B4 located between the third gate line GL3 and the fourth gate line GL4 and arranged in order along the third gate line GL3.

The first red pixel cell R1 is connected to one side of the first data line DL1 and the first gate line GL1.

The first green pixel cell G1 is connected to the other side of the first data line DL1 and the second gate line GL2.

The first blue pixel cell B1 is connected to one side of the second data line DL2 and the second gate line GL2.

The second red pixel cell R2 is connected to the other side of the second data line DL2 and the first gate line GL1.

The second green pixel cell G2 is connected to one side of the third data line DL3 and the second gate line GL2.

The second blue pixel cell B2 is connected to the other side of the third data line DL3 and the first gate line GL1.

The third red pixel cell R3 is connected to one side of the first data line DL1 and the third gate line GL3.

The third green pixel cell G3 is connected to the other side of the first data line DL1 and the fourth gate line GL4.

The third blue pixel cell B3 is connected to one side of the second data line DL2 and the fourth gate line GL4.

The fourth red pixel cell R4 is connected to the other side of the second data line DL2 and the third gate line GL3.

The fourth green pixel cell G4 is connected to one side of the third data line DL3 and the fourth gate line GL4.

The fourth blue pixel cell B4 is connected to the other side of the third data line DL3 and the third gate line GL3.

Here, the pixels connected to the first data line DL1 are driven in the order of the first red pixel cell R1, first green pixel cell G1, third red pixel cell R3 and third green pixel cell G3.

The pixels connected to the second data line DL2 are driven in the order of the second red pixel cell R2, first blue pixel cell B1, fourth red pixel cell R4 and third blue pixel cell B3.

The pixels connected to the third data line DL3 are driven in the order of the second blue pixel cell B2, second green pixel cell G2, fourth blue pixel cell B4 and fourth green pixel cell G4.

The operation of the LCD device with the above-stated configuration according to the second embodiment of the present invention will hereinafter be described.

A description will hereinafter be given of an operation for a first period T1 in an arbitrary frame period.

In the first period T1, a first gate signal GS1 is outputted and supplied to the first gate line GL1. As a result, the first red pixel cell R1, second red pixel cell R2 and second blue pixel cell B2 connected to the first gate line GL1 are driven at the same time.

In this first period T1, a positive data signal Data1 is charged on the first data line DL1, a negative data signal Data2 is charged on the second data line DL2, and a positive data signal Data3 is charged on the third data line DL3.

Hence, in this first period T1, the first red pixel cell R1 is supplied with the positive data signal Data1 charged on the first data line DL1 to display an image, the second red pixel cell R2 is supplied with the negative data signal Data2 charged on the second data line DL2 to display an image, and the second blue pixel cell B2 is supplied with the positive data signal Data3 charged on the third data line DL3 to display an image.

Here, in a period immediately preceding the first period T1, namely, an mth period Tm included in a frame period immediately preceding the arbitrary frame period, the first data line DL1 was charged with a negative data signal Data1, the second data line DL2 was charged with a positive data signal Data2, and the third data line DL3 was charged with a negative data signal Data3.

As a result, in the first period T1, the first data line DL1 is charged from the negative data signal Data1 to the positive data signal Data1, the second data line DL2 is charged from the positive data signal Data2 to the negative data signal Data2, and the third data line DL3 is charged from the negative data signal Data3 to the positive data signal Data3.

This first period T1 is a time for which a data signal Data1 corresponding to the first red pixel cell R1, a data signal Data2 corresponding to the second red pixel cell R2, and a data signal Data3 corresponding to the second blue pixel cell B2 are supplied to the first, second and third data lines DL1, DL2 and DL3, respectively. The first red pixel cell R1 and the second red pixel cell R2 are supplied with the data signals Data1 and Data2 in the same charged states.

That is, the data signal Data1 supplied to the first data line DL1 in the first period T1 in which the first red pixel cell R1 is supplied with the data signal Data1 has an opposite polarity to that of the data signal Data1 supplied to the first data line DL1 in a period immediately preceding this first period T1, namely, the mth period Tm. Also, the data signal Data2 supplied to the second data line DL2 in the first period T1 in which the second red pixel cell R2 is supplied with the data signal Data2 has an opposite polarity to that of the data signal Data2 supplied to the second data line DL2 in the mth period Tm.

Therefore, provided that the data signals Data1 and Data2 of the same gray scale are supplied to the first and second data lines DL1 and DL2 in the first period T1, the first red pixel cell R1 and the second red pixel cell R2 will display images of the same brightness.

Next, a description will be given of an operation for a second period T2 in the arbitrary frame period.

In the second period T2, a second gate signal GS2 is outputted and supplied to the second gate line GL2. As a result, the first green pixel cell G1, first blue pixel cell B1 and second green pixel cell G2 connected to the second gate line GL2 are driven at the same time.

In this second period T2, a positive data signal Data1 is charged on the first data line DL1, a negative data signal Data2 is charged on the second data line DL2, and a positive data signal Data3 is charged on the third data line DL3. That is, the data signals Data1 , Data2 and Data3 supplied respectively to the data lines DL1 to DL3 in the first period T1 are the same in polarity as the data signals Data1, Data2 and Data3 supplied respectively to the data lines DL1 to DL3 in the second period T2, respectively.

Thus, in this second period T2, the first green pixel cell G1 is supplied with the positive data signal Data1 charged on the first data line DL1 to display an image, the first blue pixel cell B1 is supplied with the negative data signal Data2 charged on the second data line DL2 to display an image, and the second green pixel cell G2 is supplied with the positive data signal Data3 charged on the third data line DL3 to display an image.

Here, in a period immediately preceding the second period T2, namely, the first period T1, the first data line DL1 was charged with a positive data signal Data1, the second data line DL2 was charged with a negative data signal Data2, and the third data line DL3 was charged with a positive data signal Data3.

As a result, in the second period T2, the first data line DL1 is charged from the positive data signal Data1 to the positive data signal Data1, the second data line DL2 is charged from the negative data signal Data2 to the negative data signal Data2, and the third data line DL3 is charged from the positive data signal Data3 to the positive data signal Data3.

This second period T2 is a time for which a data signal Data1 corresponding to the first green pixel cell G1, a data signal Data2 corresponding to the first blue pixel cell B1, and a data signal Data3 corresponding to the second green pixel cell G2 are supplied to the first, second and third data lines DL1, DL2 and DL3, respectively. The first green pixel cell G1 and the second green pixel cell G2 are supplied with the data signals Data1 and Data3 in the same charged states.

That is, the data signal Data supplied to the first data line DL1 in the second period T2 in which the first green pixel cell G1 is supplied with the data signal Data1 has the same polarity as that of the data signal Data1 supplied to the first data line DL1 in a period immediately preceding this second period T2, namely, the first period T1. Also, the data signal Data3 supplied to the third data line DL3 in the second period T2 in which the second green pixel cell G2 is supplied with the data signal Data3 has the same polarity as that of the data signal Data3 supplied to the third data line DL3 in the first period T1.

Therefore, provided that the data signals Data1 and Data3 of the same gray scale are supplied to the first and third data lines DL1 and DL3 in the second period T2, the first green pixel cell G1 and the second green pixel cell G2 will display images of the same brightness.

Next, a description will be given of an operation for a third period T3 in the arbitrary frame period.

In the third period T3, a third gate signal GS3 is outputted and supplied to the third gate line GL3. As a result, the third red pixel cell R3, fourth red pixel cell R4 and fourth blue pixel cell B4 connected to the third gate line GL3 are driven at the same time.

In this third period T3, a negative data signal Data1 is charged on the first data line DL1, a positive data signal Data2 is charged on the second data line DL2, and a negative data signal Data3 is charged on the third data line DL3. That is, the data signals Data1, Data2 and Data3 supplied respectively to the data lines DL1 to DL3 in the third period T3 are opposite in polarity to the data signals Data1, Data2 and Data3 supplied respectively to the data lines DL1 to DL3 in the second period T2, respectively.

Accordingly, in this third period T3, the third red pixel cell R3 is supplied with the negative data signal Data1 charged on the first data line DL1 to display an image, the fourth red pixel cell R4 is supplied with the positive data signal Data2 charged on the second data line DL2 to display an image, and the fourth blue pixel cell B4 is supplied with the negative data signal Data3 charged on the third data line DL3 to display an image.

Here, in a period immediately preceding the third period T3, namely, the second period T2, the first data line DL1 was charged with a positive data signal Data1, the second data line DL2 was charged with a negative data signal Data2, and the third data line DL3 was charged with a positive data signal Data3.

As a result, in the third period T3, the first data line DL1 is charged from the positive data signal Data1 to the negative data signal Data1, the second data line DL2 is charged from the negative data signal Data2 to the positive data signal Data2, and the third data line DL3 is charged from the positive data signal Data3 to the negative data signal Data3.

This third period T3 is a time for which a data signal Data1 corresponding to the third red pixel cell R3, a data signal Data2 corresponding to the fourth red pixel cell R4, and a data signal Data3 corresponding to the fourth blue pixel cell B4 are supplied to the first, second and third data lines DL1, DL2 and DL3, respectively. The third red pixel cell R3 and the fourth red pixel cell R4 are supplied with the data signals Data1 and Data2 in the same charged states.

That is, the data signal Data1 supplied to the first data line DL1 in the third period T3 in which the third red pixel cell R3 is supplied with the data signal Data1 has an opposite polarity to that of the data signal Data1 supplied to the first data line DL1 in a period immediately preceding this third period T3, namely, the second period T2. Also, the data signal Data2 supplied to the second data line DL2 in the third period T3 in which the fourth red pixel cell R4 is supplied with the data signal Data2 has an opposite polarity to that of the data signal Data2 supplied to the second data line DL2 in the second period T2.

Accordingly, provided that the data signals Data1 and Data2 of the same gray scale are supplied to the first and second data lines DL1 and DL2 in the third period T3, the third red pixel cell R3 and the fourth red pixel cell R4 will display images of the same brightness.

Next, a description will be given of an operation for a fourth period T4 in the arbitrary frame period.

In the fourth period T4, a fourth gate signal GS4 is outputted and supplied to the fourth gate line GL4. As a result, the third green pixel cell G3, third blue pixel cell B3 and fourth green pixel cell G4 connected to the fourth gate line GL4 are driven at the same time.

In this fourth period T4, a negative data signal Data1 is charged on the first data line DL1, a positive data signal Data2 is charged on the second data line DL2, and a negative data signal Data3 is charged on the third data line DL3. That is, the data signals Data1, Data2 and Data3 supplied respectively to the data lines DL1 to DL3 in the fourth period T4 are the same in polarity as the data signals Data1, Data2 and Data3 supplied respectively to the data lines DL1 to DL3 in the third period T3, respectively.

Thus, in this fourth period T4, the third green pixel cell G3 is supplied with the negative data signal Data1 charged on the first data line DL1 to display an image, the third blue pixel cell B3 is supplied with the positive data signal Data2 charged on the second data line DL2 to display an image, and the fourth green pixel cell G4 is supplied with the negative data signal Data3 charged on the third data line DL3 to display an image.

Here, in a period immediately preceding the fourth period T4, namely, the third period T3, the first data line DL1 was charged with a negative data signal Data1, the second data line DL2 was charged with a positive data signal Data2, and the third data line DL3 was charged with a negative data signal Data3.

As a result, in the fourth period T4, the first data line DL1 is charged from the negative data signal Data1 to the negative data signal Data1, the second data line DL2 is charged from the positive data signal Data2 to the positive data signal Data2, and the third data line DL3 is charged from the negative data signal Data3 to the negative data signal Data3.

This fourth period T4 is a time for which a data signal Data1 corresponding to the third green pixel cell G3, a data signal Data2 corresponding to the third blue pixel cell B3, and a data signal Data3 corresponding to the fourth green pixel cell G4 are supplied to the first, second and third data lines DL1, DL2 and DL3, respectively. The third green pixel cell G3 and the fourth green pixel cell G4 are supplied with the data signals Data1 and Data3 in the same charged states.

That is, the data signal Data1 supplied to the first data line DL1 in the fourth period T4 in which the third green pixel cell G3 is supplied with the data signal Data1 has the same polarity as that of the data signal Data1 supplied to the first data line DL1 in a period immediately preceding this fourth period T4, namely, the third period T3. Also, the data signal Data3 supplied to the third data line DL3 in the fourth period T4 in which the fourth green pixel cell G4 is supplied with the data signal Data3 has the same polarity as that of the data signal Data3 supplied to the third data line DL3 in the third period T3.

Therefore, provided that the data signals Data1 and Data3 of the same gray scale are supplied to the first and third data lines DL1 and DL3 in the fourth period T4, the third green pixel cell G3 and the fourth green pixel cell G4 will display images of the same brightness.

In this manner, the green pixels G1, G2 and G3 and the red pixels R1, R2 and R3 are supplied with data signals in the same charged states of the corresponding data lines.

Meanwhile, the unit pixel array of the block B may be divided into a first unit pixel array including the first red pixel cell R1, first green pixel cell G1, first blue pixel cell B1, second red pixel cell R2, second green pixel cell G2 and second blue pixel cell B2, and a second unit pixel array including the third red pixel cell R3, third green pixel cell G3, third blue pixel cell B3, fourth red pixel cell R4, fourth green pixel cell G4 and fourth blue pixel cell B4. These first and second unit pixel arrays have the same structures. Therefore, the liquid crystal panel 400 of the second embodiment of the present invention may be considered to have a plurality of first unit pixel arrays formed in matrix form.

On the other hand, in the second embodiment of the present invention, the position of the first red pixel cell R1 and the position of the first green pixel cell G1 may be changed to each other. That is, the first red pixel cell R1 may be located at the seat of the first green pixel cell G1, and the first green pixel cell G1 may be located at the seat of the first red pixel cell R1. In other words, the seat of the first red pixel cell R1 and the seat of the first green pixel cell G1 may be changed to each other.

Of course, for the aforementioned change in the pixel cell positions, it is necessary to change the seat of the second red pixel cell R2 and the seat of the second green pixel cell G2 to each other, the seat of the third red pixel cell R3 and the seat of the third green pixel cell G3 to each other, and the seat of the fourth red pixel cell R4 and the seat of the fourth green pixel cell G4 to each other.

Figure 8:
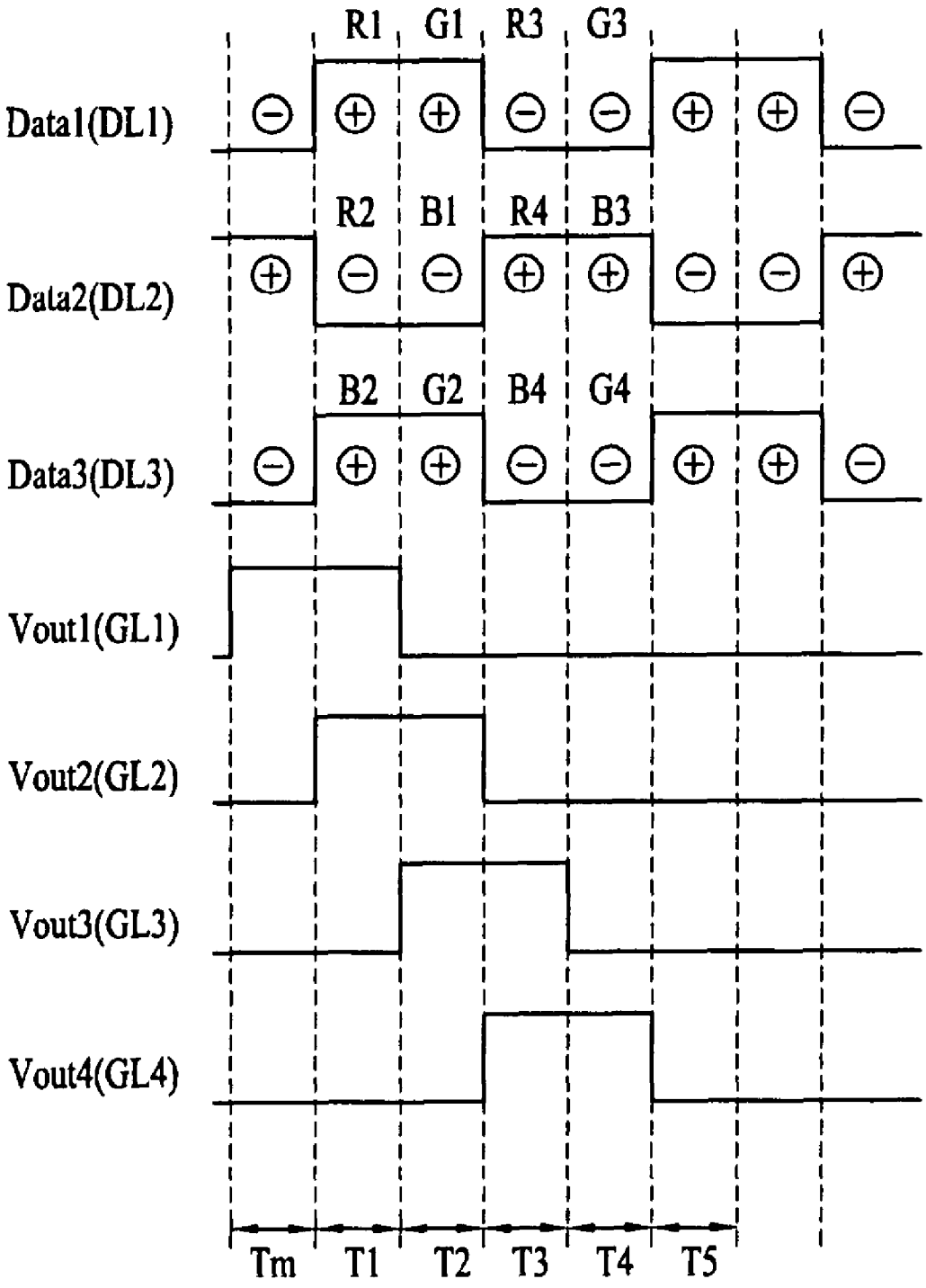
FIG. 8 is another timing diagram of the gate signals and data signals supplied to the pixels in FIG. 6.

FIG. 8 is another timing diagram of the gate signals and data signals supplied to the pixels in FIG. 6. The gate lines may be supplied with gate signals which assume a high state simultaneously for a predetermined period.

The first to fourth gate signals GS1 to GS4 are outputted in order. At this time, gate signals outputted in adjacent periods, among the first to fourth gate signals GS1 to GS4, assume a high state simultaneously for a period of about (½)H.

Each of the gate signals GS1 to GS4 has a first high duration and a second high duration. The first high duration of each gate signal overlaps with the second high duration of the immediately previously outputted gate signal. As a result, the adjacent gate lines are driven simultaneously for the (½)H period.

Each of the gate lines GL1 to GL4 is precharged for the first high duration and then fully charged for the second high duration. In this second high duration for which each gate line is fully charged, actual data signals corresponding to pixels to be currently driven are supplied to the data lines.

The gate signals shown in FIG. 8 are also applicable to the unit pixel array of FIG. 3.

Next, an LCD device according to a third embodiment of the present invention will be described.

Figure 9:
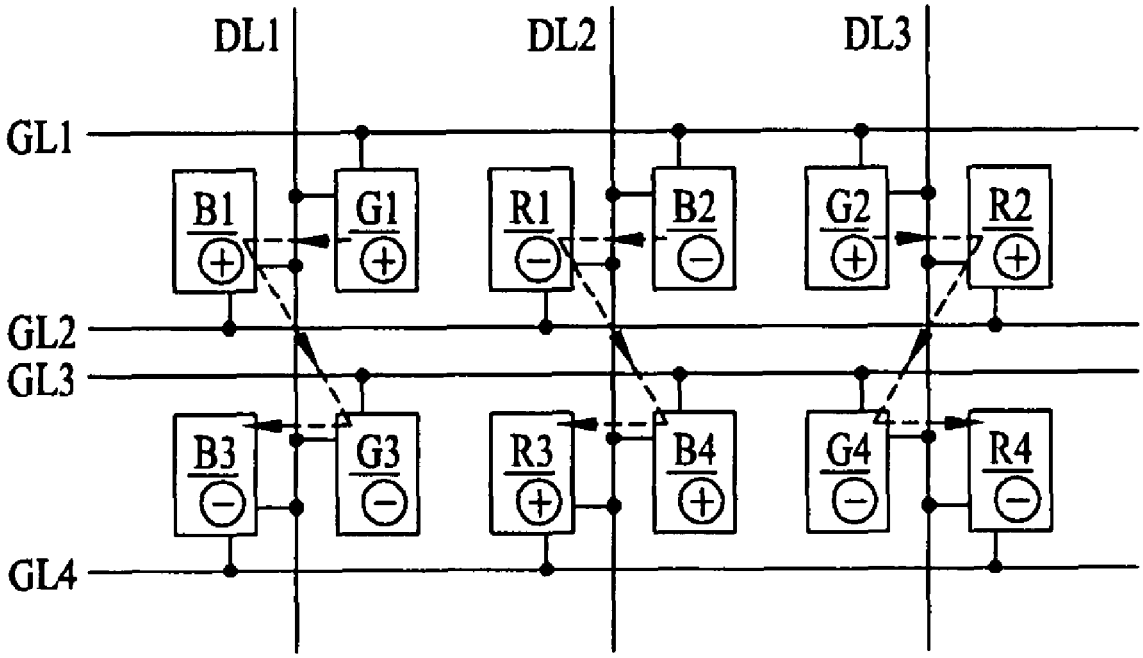
FIG. 9 is a schematic view of a unit pixel array of a liquid crystal display device according to a third embodiment of the present invention.

FIG. 9 is a schematic view of a unit pixel array of the LCD device according to the third embodiment of the present invention.

The LCD device according to the third embodiment of the present invention has a plurality of unit pixel arrays, one of which is shown in FIG. 9.

As shown in FIG. 9, the unit pixel array includes first, second and third data lines DL1, DL2 and DL3 arranged in one direction, first, second, third and fourth gate lines GL1, GL2, GL3 and GL4 arranged to cross the first to third data lines DL1 to DL3, first blue, first green, first red, second blue, second green and second red pixels B1, G1, R1, B2, G2 and R2 located between the first gate line GL1 and the second gate line GL2 and arranged in order along the first and second gate lines GL1 and GL2, and third blue, third green, third red, fourth blue, fourth green and fourth red pixels B3, G3, R3, B4, G4 and R4 located between the third gate line GL3 and the fourth gate line GL4 and arranged in order along the third and fourth gate lines GL3 and GL4.

The first blue pixel cell B1 is connected to one side of the first data line DL1 and the second gate line GL2.

The first green pixel cell G1 is connected to the other side of the first data line DL1 and the first gate line GL1.

The first red pixel cell R1 is connected to one side of the second data line DL2 and the second gate line GL2.

The second blue pixel cell B2 is connected to the other side of the second data line DL2 and the first gate line GL1.

The second green pixel cell G2 is connected to one side of the third data line DL3 and the first gate line GL1.

The second red pixel cell R2 is connected to the other side of the third data line DL3 and the second gate line GL2.

The third blue pixel cell B3 is connected to one side of the first data line DL1 and the fourth gate line GL4.

The third green pixel cell G3 is connected to the other side of the first data line DL1 and the third gate line GL3.

The third red pixel cell R3 is connected to one side of the second data line DL2 and the fourth gate line GL4.

The fourth blue pixel cell B4 is connected to the other side of the second data line DL2 and the third gate line GL3.

The fourth green pixel cell G4 is connected to one side of the third data line DL3 and the third gate line GL3.

The fourth red pixel cell R4 is connected to the other side of the third data line DL3 and the fourth gate line GL4.

The LCD device with the above-stated configuration according to the third embodiment of the present invention may be supplied with the gate signals and data signals as shown in FIG. 4 or FIG. 8.

On the other hand, in the third embodiment of the present invention, the position of the first green pixel cell G1 and the position of the first red pixel cell R1 may be changed to each other. That is, the first green pixel cell G1 may be located at the seat of the first red pixel cell R1, and the first red pixel cell R1 may be located at the seat of the first green pixel cell G1. In other words, the seat of the first green pixel cell G1 and the seat of the first red pixel cell R1 may be changed to each other.

Of course, for the aforementioned change in the pixel cell positions, it is necessary to change the seat of the second green pixel cell G2 and the seat of the second red pixel cell R2 to each other, the seat of the third green pixel cell G3 and the seat of the third red pixel cell R3 to each other, and the seat of the fourth green pixel cell G4 and the seat of the fourth red pixel cell R4 to each other.

Figure 10:
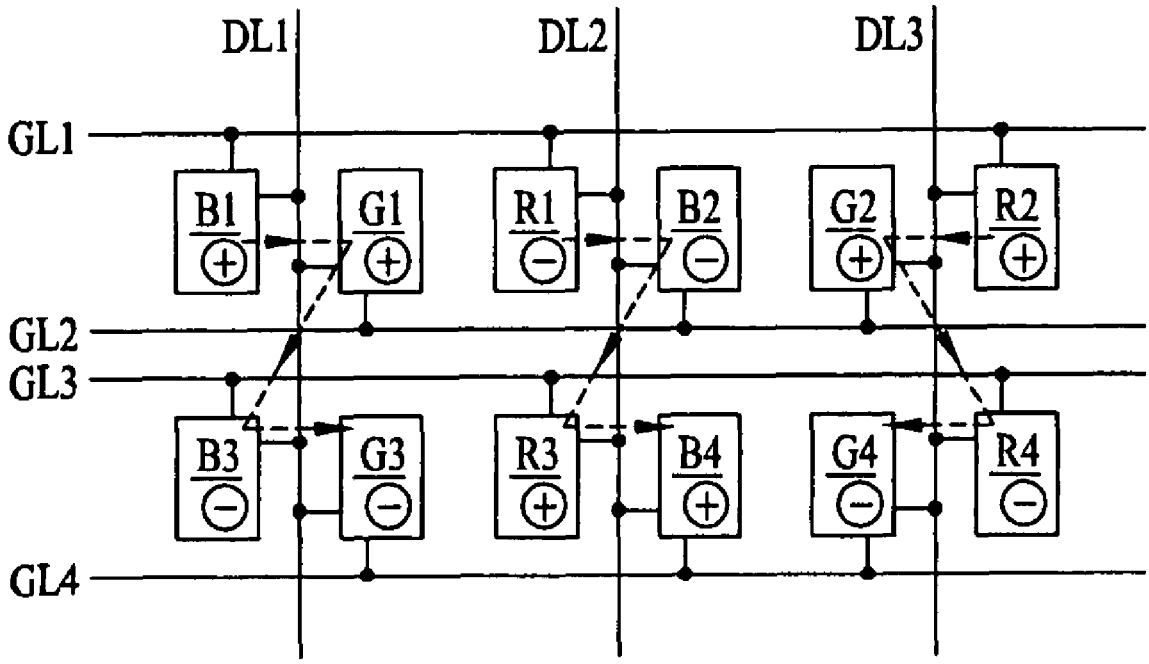
FIG. 10 is a schematic view of a unit pixel array of a liquid crystal display device according to a fourth embodiment of the present invention.

FIG. 10 is a schematic view of a unit pixel array of an LCD device according to a fourth embodiment of the present invention.

The LCD device according to the fourth embodiment of the present invention has a plurality of unit pixel arrays, one of which is shown in FIG. 10.

As shown in FIG. 10, the unit pixel array includes first, second and third data lines DL1, DL2 and DL3 arranged in one direction, first, second, third and fourth gate lines GL1, GL2, GL3 and GL4 arranged to cross the first to third data lines DL1 to DL3, first blue, first green, first red, second blue, second green and second red pixels B1, G1, R1, B2, G2 and R2 located between the first gate line GL1 and the second gate line GL2 and arranged in order along the first and second gate lines GL1 and GL2, and third blue, third green, third red, fourth blue, fourth green and fourth red pixels B3, G3, R3, B4, G4 and R4 located between the third gate line GL3 and the fourth gate line GL4 and arranged in order along the third and fourth gate lines GL3 and GL4.

The first blue pixel cell B1 is connected to one side of the first data line DL1 and the first gate line GL1.

The first green pixel cell G1 is connected to the other side of the first data line DL1 and the second gate line GL2.

The first red pixel cell R1 is connected to one side of the second data line DL2 and the first gate line GL1.

The second blue pixel cell B2 is connected to the other side of the second data line DL2 and the second gate line GL2.

The second green pixel cell G2 is connected to one side of the third data line DL3 and the second gate line GL2.

The second red pixel cell R2 is connected to the other side of the third data line DL3 and the first gate line GL1.

The third blue pixel cell B3 is connected to one side of the first data line DL1 and the third gate line GL3.

The third green pixel cell G3 is connected to the other side of the first data line DL1 and the fourth gate line GL4.

The third red pixel cell R3 is connected to one side of the second data line DL2 and the third gate line GL3.

The fourth blue pixel cell B4 is connected to the other side of the second data line DL2 and the fourth gate line GL4.

The fourth green pixel cell G4 is connected to one side of the third data line DL3 and the fourth gate line GL4.

The fourth red pixel cell R4 is connected to the other side of the third data line DL3 and the third gate line GL3.

The LCD device with the above-stated configuration according to the fourth embodiment of the present invention may be supplied with the gate signals and data signals as shown in FIG. 4 or FIG. 8.

On the other hand, in the fourth embodiment of the present invention, the position of the first green pixel cell G1 and the position of the first red pixel cell R1 may be changed to each other. That is, the first green pixel cell G1 may be located at the seat of the first red pixel cell R1, and the first red pixel cell R1 may be located at the seat of the first green pixel cell G1. In other words, the seat of the first green pixel cell G1 and the seat of the first red pixel cell R1 may be changed to each other.

Of course, for the aforementioned change in the pixel cell positions, it is necessary to change the seat of the second green pixel cell G2 and the seat of the second red pixel cell R2 to each other, the seat of the third green pixel cell G3 and the seat of the third red pixel cell R3 to each other, and the seat of the fourth green pixel cell G4 and the seat of the fourth red pixel cell R4 to each other.

As apparent from the above description, the LCD device according to the present invention has effects as follows.

Green pixels and red pixels are supplied with data signals in the same charged states of corresponding data lines. Therefore, it is possible to improve the picture quality of the LCD device.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display device comprising:

first, second and third data lines arranged in one direction;

a data driver for alternately supplying a data signal of a first polarity and a data signal of a second polarity to each of the first, second and third data lines at intervals of two periods, and supplying the data signal of the first polarity and the data signal of the second polarity to adjacent ones of the data lines;

first and second gate lines arranged to cross the first to third data lines;

a gate driver for sequentially driving the first and second gate lines; and first blue, first green, first red, second blue, second green and second red pixels located between the first gate line and the second gate line and arranged in order along the first and second gate lines, wherein the first blue pixel cell is connected to one side of the first data line and the second gate line, wherein the first green pixel cell is connected to the other side of the first data line and the first gate line, wherein the first red pixel cell is connected to one side of the second data line and the second gate line, wherein the second blue pixel cell is connected to the other side of the second data line and the first gate line, wherein the second green pixel cell is connected to one side of the third data line and the first gate line, wherein the second red pixel cell is connected to the other side of the third data line and the second gate line.

2. The liquid crystal display device according to claim 1, further comprising:

third and fourth gate lines arranged to cross the first to third data lines; and third blue, third green, third red, fourth blue, fourth green and fourth red pixels located between the third gate line and the fourth gate line and arranged in order along the third and fourth gate lines, wherein the gate driver drives the first to fourth gate lines in order from the first gate line to the fourth gate line, wherein the third blue pixel cell is connected to one side of the first data line and the fourth gate line, wherein the third green pixel cell is connected to the other side of the first data line and the third gate line, wherein the third red pixel cell is connected to one side of the second data line and the fourth gate line, wherein the fourth blue pixel cell is connected to the other side of the second data line and the third gate line, wherein the fourth green pixel cell is connected to one side of the third data line and the third gate line, wherein the fourth red pixel cell is connected to the other side of the third data line and the fourth gate line.

* * * * *